US007844430B2

(12) United States Patent
Landis, Jr. et al.

(10) Patent No.: US 7,844,430 B2
(45) Date of Patent: Nov. 30, 2010

(54) RESERVOIR MODEL BUILDING METHODS

(75) Inventors: Lester H. Landis, Jr., Houston, TX (US); Peter N. Glenton, Victoria (AU)

(73) Assignee: ExxonMobil Upstream Research Co., Houston, TX (US)

( * ) Notice: Subject to any disclaimer, the term of this patent is extended or adjusted under 35 U.S.C. 154(b) by 997 days.

(21) Appl. No.: 10/573,089

(22) PCT Filed: Jan. 24, 2005

(86) PCT No.: PCT/US2005/003103

§ 371 (c)(1),
(2), (4) Date: Mar. 23, 2006

(87) PCT Pub. No.: WO2005/074592

PCT Pub. Date: Aug. 18, 2005

(65) Prior Publication Data

US 2007/0061117 A1 Mar. 15, 2007

Related U.S. Application Data

(60) Provisional application No. 60/540,794, filed on Jan. 30, 2004.

(51) Int. Cl.
*G06G 7/48* (2006.01)

(52) U.S. Cl. ..... 703/10

(58) Field of Classification Search ..... 703/10
See application file for complete search history.

(56) References Cited

U.S. PATENT DOCUMENTS

| | | | |
|---|---|---|---|
| 5,018,112 | A | 5/1991 | Pinkerton et al. |
| 5,757,663 | A | 5/1998 | Lo et al. |
| 5,835,882 | A | 11/1998 | Vienot et al. |
| 5,835,883 | A | 11/1998 | Neff et al. |
| 6,106,561 | A | 8/2000 | Farmer |
| 6,302,221 | B1 | 10/2001 | Hamman et al. |
| 6,374,201 | B1 | 4/2002 | Grizon et al. |
| 6,549,854 | B1 | 4/2003 | Malinverno et al. |
| 6,662,109 | B2 | 12/2003 | Roggero et al. |
| 6,662,146 | B1 | 12/2003 | Watts |
| 6,694,264 | B2 | 2/2004 | Grace |
| 6,754,588 | B2 | 6/2004 | Cross et al. |
| 6,792,354 | B1 | 9/2004 | O'Meara, Jr. |
| 6,826,483 | B1 | 11/2004 | Anderson et al. |
| 6,865,486 | B2 | 3/2005 | Tobias et al. |

(Continued)

FOREIGN PATENT DOCUMENTS

| | | |
|---|---|---|
| WO | WO 00/48022 | 8/2000 |

(Continued)

OTHER PUBLICATIONS

Sabathier et al.; A New Approach of Fractured Reservoirs; SPE 39825; 1998; pp. 1-12.*

(Continued)

*Primary Examiner*—Hugh Jones

(57) ABSTRACT

Disclosed are various reservoir model generation methods. At least one of the methods includes providing a first framework having a plurality of cells, wherein the first framework is a reservoir framework and providing a second framework having a plurality of cells, wherein the volume of the first framework is greater than the volume of the second framework.

18 Claims, 4 Drawing Sheets

U.S. PATENT DOCUMENTS

| | | | |
|---|---|---|---|
| 6,950,751 | B2 | 9/2005 | Knobloch |
| 6,980,940 | B1 | 12/2005 | Gurpinar et al. |
| 2003/0046005 | A1 | 3/2003 | Haarstad |

FOREIGN PATENT DOCUMENTS

| | | | |
|---|---|---|---|
| WO | WO 00/79423 | A1 | 12/2000 |
| WO | WO 2005/076124 | A1 | 8/2005 |

OTHER PUBLICATIONS

Bouska et al., Validating Reservoir Models to Improve Recovery; Figure from p. 35; 1999; obtained from http://www.slb.com/media/services/resources/oilfieldreview/ors99/sum99/validating.pdf.*

Bean et al. Probabilistic Pay Flags and Reservoir Quality in Greater Burgan Field, Kuwait. AAPG International Conference, Barcelona, Spain, Sep. 21-24, 2003; pp. 1-6.*

J. E. Aarnes et al., "Toward Reservoir Simulation on Geological Grid Models", European Conference on the Mathematics of Oil Recovery, Cannes, France, Aug. 30-Sep. 2, 2004, pp. 1-8.

M. Abbaszadeh et al., "Integrated Geostatistical Reservoir Characterization of Turbidite Sandstone Deposits in Chicontepec Basin, Gulf of Mexico", SPE 84052, Oct. 5, 2003, pp. 1-15, XP002289310.

J. S. Gomes et al., "Geological Modeling of a Tight Carbonate Reservoir for Improved Reservoir Management of a Miscible WAG Injection Project, Abu Dhabi, U.A.E.", SPE 78529, Oct. 13, 2002, pp. 1-11, XP002289311.

R. P. Kendall et al., "The Impact of Vector Processors on Petroleum Reservoir Simulation", Proceedings of the IEEE, vol. 72 No. 1, Jan. 1984, pp. 85-89.

P. Mendoza et al., "Fault Interpretation Strategy for 3D model Simulation", SPE 78994, Nov. 4, 2003, pp. 1-11, XP02289312.

S. Narayanan et al., "Applying Database Support for Large Scale Data Driven Science in Distributed Environments", Proceedings of the Fourth International Workshop on Grid Computing, IEEE, Nov. 2003, pp. 141-148, 8 pages.

M. L. Sweet et al., "Modeling Heterogeneity in a Low-Permeability Gas Reservoir Using Geostatistical Techniques, Hyde Field, Southern North Sea", AAPG Bulletin, V. 80 No. 11, Nov. 1996, pp. 1719-1735.

G. J. J. Williams et al., "Top-Down Reservoir Modeling", SPE 89974, SPE Annual Technical Conference, Houston, Texas, Sep. 26-29, 2004, pp. 1-8.

T. Yu, "Evolving Cellular Automata to Model Fluid Flow in Porous Media", 2002 NASA/DOD Conference on Evolvable Hardware, IEEE, Jul. 2002, 8 pages.

European Search Report No. 111082, dated Jul. 30, 2004 for U.S. Appl. No. 60/540,794, 3 pages.

PCT International Search Report and Written Opinion of the International Searching Authority, mailed Dec. 23, 2005 for PCT/US05/03103, 8 pages.

K. Gruchalla, "Immersive Well-Path Editing: Investigating the Added Value of Immersion", Proceedings of the 2004 IEEE Virtual Reality, Chicago, Il, Mar. 27-31, 2004, pp. 157-164.

J. G. Kim et al., "Toward a Grid-Based Simulation of Multiphase Fluid Flow in Porous Media", Proceedings of the 18$^{th}$ International Parallel and Distributed Processing Symposium, IEEE, 2004, 4 pages.

V. Mottl et al., "Pattern Recognition in Spatial Data: A New Method of Seismic Explorations for Oil and Gas in Crystalline Basement Rocks", IEEE, 2000, pp. 315-318.

* cited by examiner

RESERVOIR MODEL BUILDING METHODS

CROSS REFERENCE TO RELATED APPLICATIONS

This application claims the benefit of U.S. Provisional Application 60/540,794, filed Jan. 30, 2004.

BACKGROUND

1. Field of Invention

Embodiments of the invention are related to evaluation of subsurface reservoirs.

2. Description of Related Art

In the oil and gas industry, geologic models are often used to aid in activities, such as determining the locations of wells, estimating hydrocarbon reserves, or planning reservoir-development strategies, including evaluating the economic recovery of hydrocarbon resources. A geologic model typically is a computer-based representation of a subsurface earth volume, such as a petroleum reservoir or a depositional basin.

Geologic models may take on many different forms. Depending on the context, descriptive or static geologic models built for petroleum applications can be in the form of a 3-D array of cells, to which geologic and/or geophysical properties such as lithology, porosity, acoustic impedance, permeability, or water saturation are assigned (such properties will be referred to collectively herein as "reservoir properties").

Many geologic models are constrained by stratigraphic or structural surfaces (e.g., flooding surfaces, sequence interfaces, fluid contacts, faults) and boundaries (e.g., facies changes). These surfaces and boundaries define regions within the model that possibly have different reservoir properties.

Various approaches can be followed for evaluating a reservoir using geologic modeling. At least one approach is strictly sequential, involving sequential evaluations by several disciplines. With such an approach, a reservoir evaluation using geologic modeling might take several or many months to complete. With such an approach, due to the large amount of time necessary for evaluating a reservoir using geologic modeling, only one geologic model would tend to be built in connection with the reservoir evaluation. Consequently, such an approach would allow no realistic opportunity to learn how decisions are made during the geologic modeling process, or how such decisions would affect the final outcome. Such a strict sequential approach would also allow no opportunity to evaluate the inherent uncertainty in arriving at solutions to problems, considering the limited amount of data that would tend to be available for use in the geologic modeling as well as the level of interpretation required in the geologic modeling process.

Furthermore, such a strict sequential approach for evaluating a reservoir using geologic modeling would in all likelihood tend to involve building a geologic model made up of many millions of cells, e.g., 200 million cells, and require "upscaling" the geologic model in order to reduce the number of cells to no more than 500,000 cells so that flow simulation could be performed. Obviously, the steps of building geologic models and then upscaling them would tend to contribute further to the large amount of time needed to evaluate a reservoir using geologic modeling.

Accordingly, a need exists for improved methods of evaluating reservoir.

SUMMARY

Embodiments of the invention are directed to a method for generating a reservoir model. In one embodiment, the method includes providing a first framework having a plurality of cells, wherein the first framework is a reservoir framework and providing a second framework having a plurality of cells, wherein the volume of the first framework is greater than the volume of the second framework.

In another embodiment, the method includes providing a first framework having a plurality of cells, wherein the first framework is a reservoir framework, and providing a second framework having a plurality of cells, wherein the volume of the second framework is substantially the same size as one of the cells of the first framework.

In yet another embodiment, the method includes providing a framework having a plurality of cells, wherein each cell is substantially the same size as a sample of the well data, identifying some or all of the cells of the framework as net or non-net, populating some or all of the cells of the framework with one or more reservoir properties to provide a reservoir cell model, and performing a flow simulation on the reservoir cell model to generate one or more effective reservoir property values.

In still another embodiment, the method includes providing a first framework having a plurality of cells, wherein the first framework is a reservoir framework, and providing a second framework having a plurality of cells, wherein each one of the cells of the second framework is substantially the same size as a sample of the well data.

DETAILED DESCRIPTION

Introduction and Definitions

Figure 1:
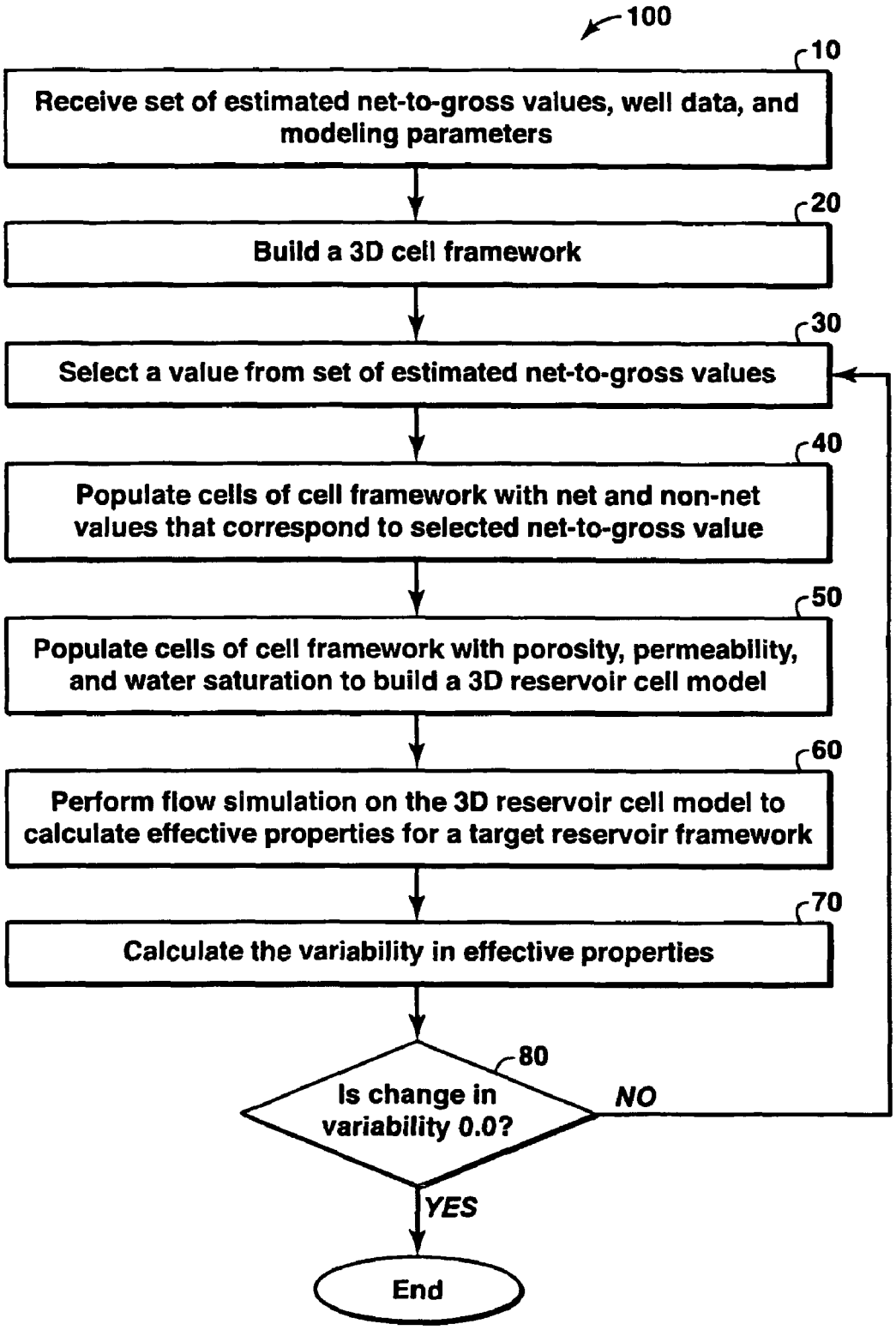
FIG. 1 illustrates a flow diagram of a method for generating one or more effective reservoir properties in accordance with one embodiment of the invention.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology. Various terms as used herein are defined below.

To the extent a term used in a claim is not defined below, it should be given the broadest definition persons in the pertinent art have given that term as reflected in printed publications and issued patents.

As used herein, the term "cell" is defined as a unit or block that defines a portion of a three dimensional reservoir model. As such, a three dimensional reservoir model may include a number of cells, ranging from tens and hundreds to thousands and millions of cells. Each cell represents a specifically allocated portion of the three dimensional reservoir model. An entire set of cells may constitute a geologic model and thus represent the subsurface earth volume of interest. Each cell preferably represents a unique portion of the subsurface. As such, the cells preferably do not overlap each other. Dimensions of the cells are preferably chosen so that the reservoir properties within a cell are relatively homogeneous, yet without creating an excessive number of cells. Preferably, each cell is square or rectangular in plan view and has a thickness that is either constant or variable. However, it is contemplated that other shapes may alternatively be used.

As used herein, the term "reservoir properties" are defined as quantities representing physical attributes of rocks containing reservoir fluids. The term "reservoir properties" as used in this application includes both measurable and descriptive attributes. Examples of measurable reservoir property values include rock-type fraction (e.g., net-to-gross, v-shale, or facies proportion), porosity, permeability, water saturation, and fracture density. Examples of descriptive reservoir property values include facies, lithology (e.g. sandstone or carbonate), and environment-of-deposition (EOD). Reservoir properties may be populated into a reservoir framework to generate a reservoir model.

The term "rock-type fraction" is defined as the ratio of the rock volume containing a specific rock-type that to the total (gross) rock volume. As such, the gross rock volume can be divided into 2 components: (1) rock volume containing a specific rock-type, and (2) rock volume containing all other rock types. So, rock-type fraction may be expressed as:

$$\text{rock-type fraction} = \frac{\text{volume of a specific rock-type}}{\text{total rock volume}}$$

Example of a rock-type fraction is v-shale (volume shale), typically calculated from electronic well log measurements and sometimes inferred from seismic data. Using the expression for rock-type fraction:

$$\text{v-shale} = \frac{\text{volume of shale}}{\text{total rock volume}}$$

The term "net-to-gross", also denoted N:G, as used herein includes the term v-shale (volume shale). The relationship between v-shale and net-to-gross may be expressed as follows:

$$\text{net-to-gross} = 1 - v\text{-shale}.$$

Furthermore, whenever the term "net-to-gross" or "N:G" is used herein, it will be understood that this is an example of a rock-type fraction, and that any other choice of rock-type fraction may be selected.

As used herein, the term "permeability" is defined as the ability of a rock to transmit fluids through interconnected pores in the rock. Permeability can vary substantially within a hydrocarbon-bearing reservoir. Typically, permeabilities are generated for fine-scale models (geologic models) using data from well core samples. For simulation cells, the heterogeneities of the geologic model are accounted for by determining an effective permeability. An effective permeability of a heterogeneous medium is defined as the permeability of an equivalent homogeneous medium that, for the same boundary conditions, would give the same flux (amount of fluid flow across a given area per unit time).

As used herein, the term "porosity" is defined as the percent volume of pore space in a rock. Porosity is a measure of the reservoir rock's storage capacity for fluids. Porosity is preferably determined from cores, sonic logs, density logs, neutron logs or resistivity logs. Total or absolute porosity includes all the pore spaces, whereas effective porosity includes only the interconnected pores.

As used herein, the term "well data" is defined as any data that may be obtained from a well. Well data include, but are not limited to, log data and core data.

As used herein, the term "geostatistical estimation" is defined as a statistical estimon technique used to spatially correlate random variables in geological or geophysical applications. Geostatistical estimation involves techniques for interpolation and extrapolation of physical measurements using correlation and probability concepts. More specifically, geostatistical estimation takes into account distance, direction, and spatial continuity of the reservoir property being modeled. Geostatistical estimation may be either deterministic or probabilistic. Deterministic geostatistical estimation calculates a minimum-variance estimate of the reservoir property at each cell. Probabilistic geostatistical estimation develops distributions of the reservoir property values and produces a suite of geologic models for the reservoir property being modeled, with each model theoretically being equally probable. The spatial continuity of a reservoir property may be captured by a variogram, a well-known technique for quantifying the variability of a reservoir property as a function of separation distance and direction.

As used herein, the term "flow simulation" is defined as a numerical method of simulating the transport of mass (typically fluids, such as oil, water and gas), energy, and momentum through a physical system using a computer. The physical system includes a three dimensional reservoir model, fluid properties, the number and locations of wells. Flow simulations also require a strategy (often called a well-management strategy) for controlling injection and production rates. These strategies are typically used to maintain reservoir pressure by replacing produced fluids with injected fluids (e.g. water and/or gas). When a flow simulation correctly recreates a past reservoir performance, it is said to be "history matched," and a higher degree of confidence is placed in its ability to predict the future fluid behavior in the reservoir.

As used herein, the term "three dimensional reservoir model" is defined as a three dimensional framework of cells that contain reservoir property values.

As used herein, the term "three dimensional framework" is defined as a numerical representation of a volume that is divided into cells. The numerical representation includes the total number of cells, their dimensions, and how they are connected to each other.

As used herein, the term "target reservoir framework" refers to the framework for a target reservoir model.

As used herein, the term "target reservoir model" is defined as a target reservoir framework populated with reservoir properties. The target reservoir model may be any reservoir model, such as a geologic model, flow simulation model, and the like.

Specific Embodiments

Various specific embodiments are described below, at least some of which are also recited in the claims.

In at least one specific embodiment, a method of generating a reservoir model, includes: providing a first framework having a plurality of cells, wherein the first framework is a reservoir framework; and providing a second framework having a plurality of cells, wherein the volume of the first framework is greater than the volume of the second framework.

In a specific embodiment of the method identified above, or of a method described elsewhere herein, the volume of the second framework is substantially the same size as one of the cells of the first framework.

In a specific embodiment of the method identified above, or of a method described elsewhere herein, each one of the cells of the second framework is substantially the same size as a sample of well data.

In a specific embodiment of the method identified above, or of a method described elsewhere herein, each one of the cells of the second framework is substantially the same size as a sample of core data.

In a specific embodiment of the method identified above, or of a method described elsewhere herein, each one of the cells of the second framework is substantially the same size as a sample of log data.

A specific embodiment of the method identified above, or of a method described elsewhere herein, further includes identifying some or all of the cells of the second framework as net or non-net.

A specific embodiment of the method identified above, or of a method described elsewhere herein, further includes identifying some or all of the cells of the second framework as sand or shale.

A specific embodiment of the method identified above, or of a method described elsewhere herein, further includes further includes populating some or all of the cells of the second framework with net and non-net values.

A specific embodiment of the method identified above, or of a method described elsewhere herein, further includes receiving one or more estimated net-to-gross values of the first framework.

A specific embodiment of the method identified above, or of a method described elsewhere herein, further includes receiving one or more estimated net-to-gross values of the first framework; and identifying some or all of the cells of the second framework as net or non-net according to the estimated net-to-gross values of the first framework.

A specific embodiment of the method identified above, or of a method described elsewhere herein, further includes receiving one or more estimated net-to-gross values of the first framework; and populating some or all of the cells of the second framework with net and non-net values according to the estimated net-to-gross values of the first framework.

A specific embodiment of the method identified above, or of a method described elsewhere herein, further includes populating some or all of the cells of the second framework with one or more reservoir property values.

A specific embodiment of the method identified above, or of a method described elsewhere herein, further includes populating some or all of the cells of the second framework with one or more porosity values.

A specific embodiment of the method identified above, or of a method described elsewhere herein, further includes populating some or all of the cells of the second framework with one or more permeability values.

A specific embodiment of the method identified above, or of a method described elsewhere herein, further includes populating some or all of the cells of the second framework with one or more water saturation values.

A specific embodiment of the method identified above, or of a method described elsewhere herein, further includes populating some or all of the cells of the second framework with one or more reservoir property values to generate a reservoir cell model; and performing a flow simulation on the reservoir cell model to generate one or more effective reservoir property values for the first framework.

A specific embodiment of the method identified above, or of a method described elsewhere herein, further includes: populating some or all of the cells of the second framework with one or more reservoir property values to generate a reservoir cell model; performing a flow simulation on the reservoir cell model to generate one or more effective reservoir property values for the first framework; and calculating the variability between the effective reservoir property values for the first framework.

A specific embodiment of the method identified above, or of a method described elsewhere herein, further includes: populating some or all of the cells of the second framework with one or more reservoir property values to generate a reservoir cell model; performing a flow simulation on the reservoir cell model to generate one or more effective reservoir property values for the first framework; calculating the variability between the effective reservoir property values for the first framework; and determining whether the rate of change in the variability between the effective reservoir property values remains substantially the same.

A specific embodiment of the method identified above, or of a method described elsewhere herein, further includes: populating some or all of the cells of the second framework with one or more reservoir property values to generate a reservoir cell model; performing a flow simulation on the reservoir cell model to generate one or more effective reservoir property values for the first framework; and populating the first framework with the effective reservoir property values to generate the reservoir model.

In a specific embodiment of the method identified above, or of a method described elsewhere herein, the reservoir model is a flow simulation model.

In a specific embodiment of the method identified above, or of a method described elsewhere herein, the reservoir model is a geologic model.

In a specific embodiment of the method identified above, or of a method described elsewhere herein, the volume of the second framework is greater than the size of one cell of the first framework.

In a specific embodiment of the method identified above, or of a method described elsewhere herein, the second framework includes two or more cell samples of the first framework, wherein each cell sample is substantially the same size as one of the cells of the first framework.

A specific embodiment of the method identified above, or of a method described elsewhere herein, further includes: populating some or all of the cells of the second framework with one or more reservoir property values to generate a reservoir cell model; and extracting one or more cell samples from the reservoir cell model, wherein each cell sample is substantially the same size as one of the cells of the first framework.

A specific embodiment of the method identified above, or of a method described elsewhere herein, further includes: populating some or all of the cells of the second framework with one or more reservoir property values to generate a reservoir cell model; and extracting one or more cell samples from the reservoir cell model, wherein each cell sample is substantially the same size as one cell of the first framework; and performing a flow simulation on the cell sample to generate one or more effective reservoir property values.

In a specific embodiment of the method identified above, or of a method described elsewhere herein, the second framework is three dimensional.

In at least one specific embodiment, a method of generating a reservoir model, includes: providing a first framework having a plurality of cells, wherein the first framework is a reservoir framework; and providing a second framework having a plurality of cells, wherein the volume of the second framework is substantially the same size as one of the cells of the first framework.

In a specific embodiment of the method identified above, or of a method described elsewhere herein, each one of the cells of the second framework is substantially the same size as a sample of well data.

In a specific embodiment of the method identified above, or of a method described elsewhere herein, each one of the cells of the second framework is substantially the same size as a sample of core data.

In a specific embodiment of the method identified above, or of a method described elsewhere herein, each one of the cells of the second framework is substantially the same size as a sample of log data.

A specific embodiment of the method identified above, or of a method described elsewhere herein, further includes: identifying some or all of the cells of the second framework as net or non-net.

A specific embodiment of the method identified above, or of a method described elsewhere herein, further includes: identifying some or all of the cells of the second framework as sand or shale.

A specific embodiment of the method identified above, or of a method described elsewhere herein, further includes: populating some or all of the cells of the second framework with net and non-net values.

A specific embodiment of the method identified above, or of a method described elsewhere herein, further includes: receiving one or more estimated net-to-gross values of the first framework.

A specific embodiment of the method identified above, or of a method described elsewhere herein, further includes: receiving one or more estimated net-to-gross values of the first framework; and identifying some or all of the cells of the second framework as net or non-net according to the estimated net-to-gross values of the first framework.

A specific embodiment of the method identified above, or of a method described elsewhere herein, further includes: receiving one or more estimated net-to-gross values of the first framework; and populating some or all of the cells of the second framework with net and non-net values according to the estimated net-to-gross values of the first framework.

A specific embodiment of the method identified above, or of a method described elsewhere herein, further includes: populating some or all of the cells of the second framework with one or more reservoir property values.

A specific embodiment of the method identified above, or of a method described elsewhere herein, further includes: populating some or all of the cells of the second framework with one or more porosity values.

A specific embodiment of the method identified above, or of a method described elsewhere herein, further includes: populating some or all of the cells of the second framework with one or more permeability values.

A specific embodiment of the method identified above, or of a method described elsewhere herein, further includes: populating some or all of the cells of the second framework with one or more water saturation values.

A specific embodiment of the method identified above, or of a method described elsewhere herein, further includes: populating some or all of the cells of the second framework with one or more reservoir property values to generate a reservoir cell model; and performing a flow simulation on the reservoir cell model to generate one or more effective reservoir property values for the first framework.

A specific embodiment of the method identified above, or of a method described elsewhere herein, further includes: populating some or all of the cells of the second framework with one or more reservoir property values to generate a reservoir cell model; performing a flow simulation on the reservoir cell model to generate one or more effective reservoir property values for the first framework; and calculating the variability between the effective reservoir property values for the first framework.

A specific embodiment of the method identified above, or of a method described elsewhere herein, further includes: populating some or all of the cells of the second framework with one or more reservoir property values to generate a reservoir cell model; performing a flow simulation on the reservoir cell model to generate one or more effective reservoir property values for the first framework; calculating the variability between the effective reservoir property values for the first framework; and determining whether the rate of change in the variability between the effective reservoir property values remains substantially the same.

A specific embodiment of the method identified above, or of a method described elsewhere herein, further includes: populating some or all of the cells of the second framework with one or more reservoir property values to generate a reservoir cell model; performing a flow simulation on the reservoir cell model to generate one or more effective reservoir property values for the first framework; and populating the first framework with the effective reservoir property values to generate the reservoir model.

In a specific embodiment of the method identified above, or of a method described elsewhere herein, the reservoir model is a flow simulation model.

In a specific embodiment of the method identified above, or of a method described elsewhere herein, the reservoir model is a geologic model.

In at least one specific embodiment, a method of generating a reservoir model, includes: providing a first framework having a plurality of cells, wherein the first framework is a reservoir framework; and providing a second framework having a plurality of cells, wherein each one of the cells of the second framework is substantially the same size as a sample of well data.

In at least one specific embodiment, a method of generating a reservoir model, includes: providing a framework having a plurality of cells, wherein each cell is the substantially same size as the well data; identifying some or all of the cells of the framework as net or non-net; populating some or all of the cells of the framework with one or more reservoir properties to provide a reservoir cell model; and performing a flow simulation on the reservoir cell model to generate one or more effective reservoir property values.

In a specific embodiment of the method identified above, or of a method described elsewhere herein, the framework is substantially the same size as one cell of a reservoir framework.

In a specific embodiment of the method identified above, or of a method described elsewhere herein, the framework is greater than the size of one cell of a reservoir framework.

In a specific embodiment of the method identified above, or of a method described elsewhere herein, identifying some or all of the cells includes populating some or all of the cells of the framework with net and non-net values that correspond to one or more estimated net-to-gross values of a reservoir framework for the reservoir model.

In a specific embodiment of the method identified above, or of a method described elsewhere herein, the sample of well data is the same size as a sample of core data.

In a specific embodiment of the method identified above, or of a method described elsewhere herein, the sample of well data is the same size as a sample of log data.

Specific Embodiments in Drawings

Specific embodiments shown in the drawings will now be described.

FIG. 1 illustrates a flow diagram of a method 100 for generating one or more effective reservoir properties in accordance with one embodiment of the invention. At step 10, a set of source data is received from the user. In one embodiment, such data includes a set of estimated net-to-gross values in the target reservoir framework, which will be described in the following paragraph below. A detailed description of the net-to-gross is provided in the definition section of this application. The set of estimated net-to-gross values may be calculated using conventional algorithms generally known by persons of ordinary skill in the art.

Another set of source data that the user may specify is well data, from which porosity, permeability and water saturation values may be obtained. The significance of porosity, permeability and water saturation values will be described later in the following paragraphs, in particular, with reference to step 50. Well data includes, but not limited to, core data and log data. A more detailed description of well data, core data and log data is provided in the definition section of this application.

In addition to receiving the abovementioned data, in accordance to one embodiment of the invention, certain modeling parameters may also be received from the user. Examples of those modeling parameters include the size for each cell in a target reservoir framework, the size for each cell in the cell framework and various geologic property modeling parameters. The target reservoir framework is defined herein as the reservoir framework into which the effective reservoir properties are populated. In one embodiment, the effective reservoir properties may be populated into the target reservoir framework to build a target reservoir model at which flow simulation can be performed, i.e., a flow simulation model. In another embodiment, the effective reservoir properties may be populated into the target reservoir framework to build a target reservoir model at a geologic scale, i.e., a geologic model.

The size for each cell in the target reservoir framework determines the size of the target reservoir model to be built. In other words, the size for each cell in the target reservoir framework determines whether the effective reservoir properties will be used to build a flow simulation model or a geologic model. The size for each cell in the target reservoir framework therefore depends upon what the user desires.

The cell framework comprises a plurality of cells, and each cell of the cell framework is configured to be substantially the same size as a sample of the well data. In one embodiment, each cell of the cell framework is substantially the same size as a sample of the core data. In another embodiment, each cell of the cell framework is substantially the same size as the log data sample size. The sample size of well data, including log data and core data, is conventional, as commonly known by persons of ordinary skill in the art.

In addition to the modeling parameters described above, various geologic property modeling parameters may be provided since these parameters may affect the geostatistical estimation algorithm used in populating the reservoir property values, which will be described in the following paragraphs with reference to steps 40 and 50. A description and/or definition for geologic modeling parameters is provided in the definition section above.

At step 20, a cell framework is built. The cell framework may be three dimensional. In another embodiment, the cell framework is substantially the same size as one cell of the target reservoir framework. In one embodiment, the size of the framework is determined by the cell size of the target reservoir framework received from the user at step 10. As such, the cell framework is configured to be substantially the same size as one cell of the target reservoir framework.

Figure 2:
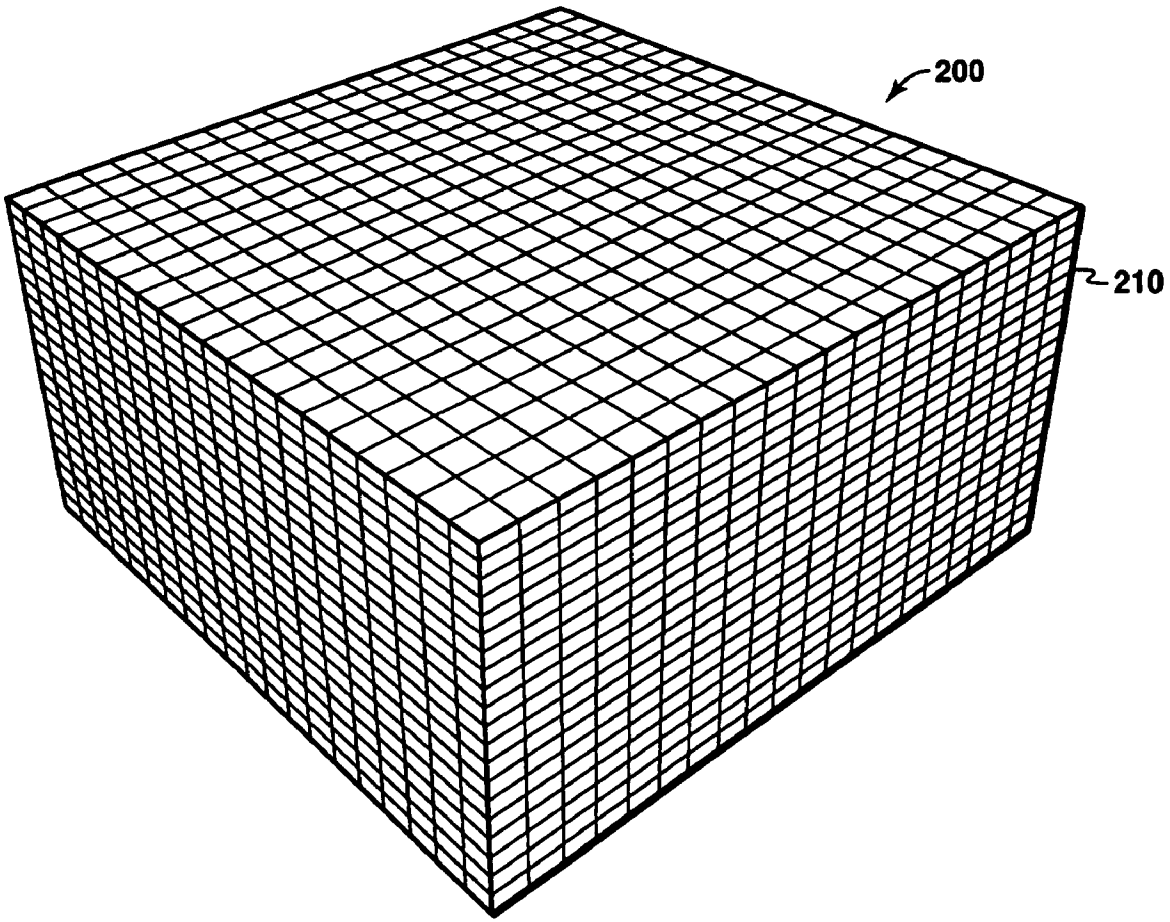
FIG. 2 illustrates a cell framework in accordance with one embodiment of the invention.

An embodiment of the cell framework is illustrated in FIG. 2 as cell framework 200. The cell framework 200 is composed of a plurality of cells 210. In one embodiment, each cell 210 is substantially the same size as a sample of the well data received at step 10. For example, each cell 210 may be substantially the same size as a sample of the core data. For another example, each cell 210 is substantially the same size as a sample of the log data. In another embodiment, the cell framework 200 and each cell 210 contained therein is cubic in shape. However, the cell framework and the cells contained therein may be in any shape conventionally known by persons of ordinary skill in the art. A more detailed description of the cell framework and the cells contained therein is provided in the definition section of this application.

Referring back to FIG. 1, once the cell framework is built, a net-to-gross value is selected from the set of estimated net-to-gross values (step 30). In one embodiment, the net-to-gross value may be randomly selected. The net-to-gross value may be in the form of a percentage. In one embodiment, the net-to-gross value is selected from a cumulative distribution function created from the set of estimated net-to-gross values. The cumulative distribution function may be derived from seismic data, regional maps, hand drawn maps, conceptual models, or even well-based models. Alternatively, the cumulative distribution function may be created using conventional techniques generally known by persons of ordinary skill in the art.

At step 40, the cells, e.g., cells 210, of the cell framework are populated with rock-type values that correspond to the selected net-to-gross value. In this manner, the cells of the cell framework are identified as rock-type 1 or rock-type 2. As such, one example for rock-type 1 is sand and one example for rock-type 2 is shale. A more detailed description of the relationship between rock-type and net-to-gross is provided in the definition section of this application. The cells of the cell framework may be populated using any conventional geostatistical estimation algorithm commonly known by persons of ordinary skill in the art. A more detailed description of geostatistical estimation algorithm is provided in the definition section of this application.

At step 50, the cells within the cell framework are populated with reservoir property values, such as porosity and permeability, to build a reservoir cell model, which may be a three dimensional reservoir cell model. In one embodiment, the porosity and permeability values may be populated in a sequential manner. That is, the cells within the cell framework may be populated with porosity values first, followed by permeability values. In another embodiment, the cells within the cell framework may also be populated with water saturation values to build the three dimensional reservoir framework cell model. The porosity, permeability and water saturation values may be obtained from the well data received from the user at step 10, as described above. As in step 40, the porosity, permeability and water saturation values may be populated using any conventional geostatistical estimation algorithm commonly known by persons with ordinary skill in the art. Porosity, permeability and water saturation values are further defined in the definition section of this application.

At step 60, a flow simulation on the three dimensional reservoir cell model is performed to generate an effective reservoir property value, which may include an effective porosity value, an effective permeability value, an effective net-to-gross value, an effective water saturation value and an effective endpoint saturation value. The effective reservoir property value is configured to be populated into the cells of the target reservoir framework. Effective porosity is defined as the volume-weighted arithmetic average of the porosity values in the target reservoir framework cell. Effective permeability of a volume of a reservoir model cell is defined as a constant permeability value of an equivalent volume that would give the same amount of flow across a given area per unit time, for the same boundary conditions. Effective permeability value may include a full permeability tensor, which typically has 3 different components that are defined by 9 different values, i.e., Kx, Ky, Kz, Kxy, Kxz, Kyz, Kyx, Kzx and Kzy.

When the cell framework is built at step 20, the volume of the cell framework is larger than the size of one cell of the target reservoir framework. That is, the cell framework is built with expanded boundary conditions, which allows a flow simulation to be performed without being limited by no-flow boundary conditions. As such, a flow simulation performed on the three dimensional reservoir cell model built with an expanded boundary condition provides a more realistic simulation pathways through the reservoir, thereby leading to more accurate effective reservoir properties. The size of the expanded boundary condition may be specified by the user at step 10 as a modeling parameter.

At step 70, the variability between the effective reservoir property values is calculated. The variability may be calculated using any conventional algorithm known by persons with ordinary skill in the art. A more detailed description of how the variability between the effective reservoir property values is calculated is provided in the definition section of this application.

At step 80, the rate of change in the variability between the effective reservoir property values is determined. If the rate of change is not near zero, then processing continues to step 30, at which another value from the set of estimated net-to-gross values is selected. On the other hand, if the rate of change is near zero, then processing ends. A near zero rate of change indicates that the variability between the effective reservoir property values has remained substantially the same.

In this manner, method 100 may be used to generate a set of effective reservoir property values, which may be populated into some or all of the cells within the target reservoir framework to build the target reservoir model. As such, various embodiments of the invention may be used as part of a method of building a reservoir model, as commonly known by persons with ordinary skill in the art. If the reservoir model is a geologic model, then the geologic model may be upscaled, e.g., using the technique described in commonly assigned publication WO 00/79423, published on Dec. 28, 2000, and the technique described therein is incorporated herein by reference. Alternatively, the geologic model may be upscaled prior to flow simulation according to conventional techniques commonly known by persons of ordinary skill in the art.

Figure 3:
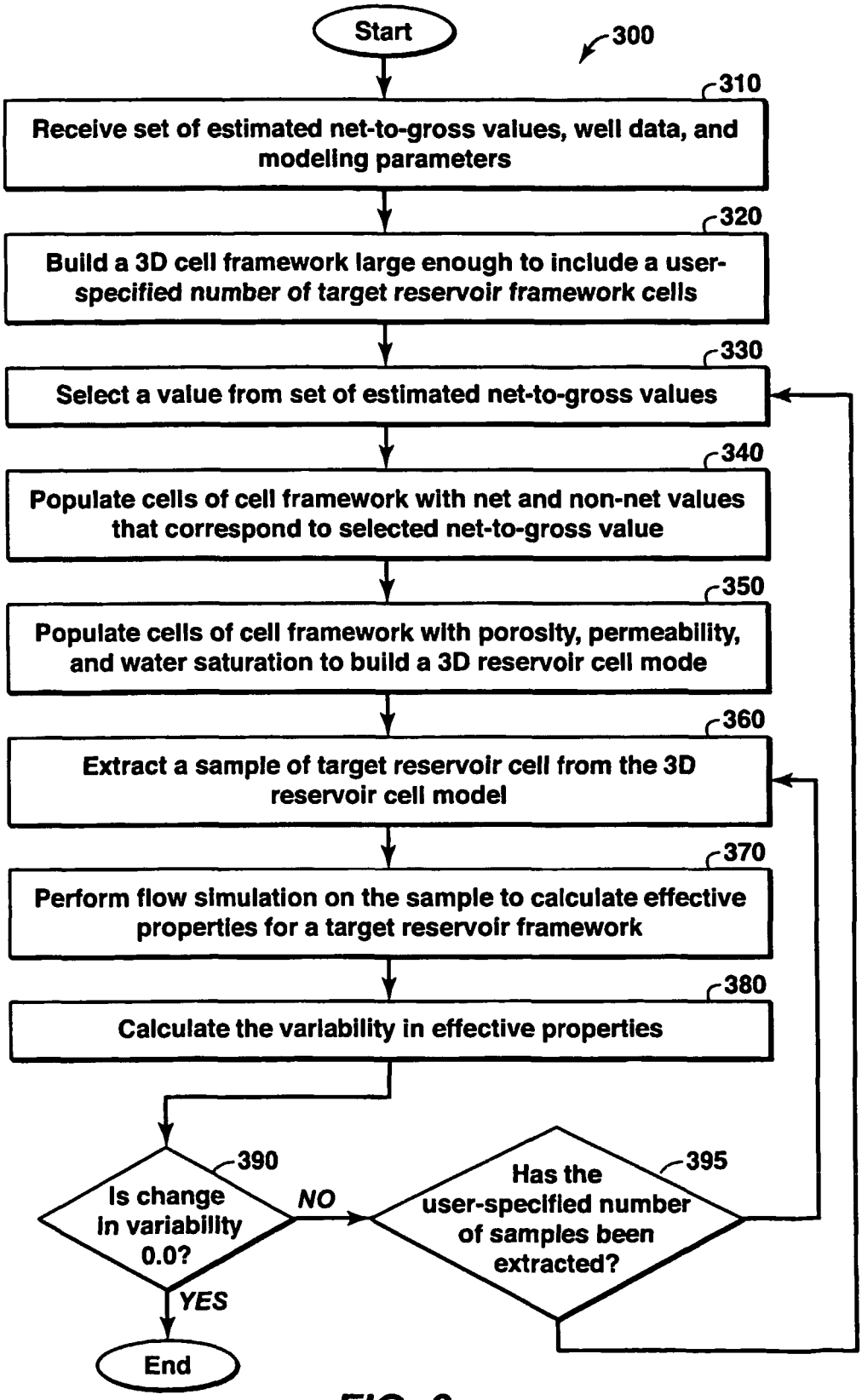
FIG. 3 illustrates a flow diagram of a method for generating one or more reservoir property values in accordance with another embodiment of the invention.

FIG. 3 illustrates a flow diagram of a method 300 for generating one or more reservoir property values in accordance with another embodiment of the invention. At step 310, a set of source data is received from the user. Such source data may include a set of estimated net-to-gross values in a target reservoir framework and well data. In addition to receiving the source data, certain modeling parameters may also be received from the user. Such modeling parameters may include the number of target reservoir framework cells to be contained inside the cell framework, the size for each cell in the target reservoir framework, and the size for each cell in the cell framework. Since step 310 performs the same function as step 10 described in FIG. 1, the reader is directed to the paragraphs above in connection with step 10 for a more detailed description of step 310.

At step 320, a three dimensional cell framework is built. The cell framework is configured to contain a number of target reservoir framework cells. This number may be provided by the user at step 310 above as one of the modeling parameters. In one embodiment, the number of target reservoir framework cells ranges from about 4 to 10. Consequently, the cell framework is much larger than the size of one target reservoir framework cell. As a point of distinction between step 20 and step 320, the cell framework built at step 320 is much larger than the cell framework built at step 20 since the cell framework built at step 20 is substantially the same size as one target reservoir framework cell. Like the cell framework described in step 20, the cell framework in step 320 is composed of a plurality of cells. Each cell is substantially the same size as a sample of the well data received at step 310. In one embodiment, each cell is substantially the same size as a sample of the core data. In another embodiment, each cell is substantially the same size as a sample of the log data. A more detailed description of the cell framework and the cells contained therein is provided above in connection with step 10.

Processing then continues to steps 330 through 350. However, steps 330 through 350 perform the same functions as steps 30 through 50. Accordingly, the reader is directed to the paragraphs above in connection with steps 30 through 50 for a detailed description of steps 330 through 350.

At step 360, a cell sample is randomly extracted from the three dimensional reservoir cell model. In one embodiment, the cell sample is substantially the same size as one target reservoir framework cell. In another embodiment, the cell size is larger than one target reservoir framework cell to allow for expanded boundary conditions (see paragraph 98 above).

At step 370, a flow simulation on the cell sample is performed to generate an effective reservoir property value, which may include an effective porosity value, an effective permeability value, an effective net-to-gross value, an effective water saturation value and an effective endpoint saturation value. A more detailed description of the effective reservoir property value, an effective porosity value, an effective permeability value, an effective net-to-gross value, an effective water saturation value and an effective endpoint saturation value is provided above with reference to step 60.

Processing then continues to step 380, which performs the same function as step 70. Accordingly, the reader is directed to the paragraphs above in connection with step 70 for a detailed description of step 380.

At step 390, the rate of change in the variability between the effective reservoir property values is determined. If the rate of change is not zero, then processing continues to step 395, which will be described in the following paragraph below. On the other hand, if the rate of change is zero, then processing ends.

At step 395, a determination is made as to whether a sample of the three dimensional reservoir framework cell model has been extracted according to the number of target reservoir framework cells specified by the user at step 310. If the answer is in the negative, then processing returns to step 360, at which another sample of the target reservoir framework cell is extracted from the three dimensional reservoir framework cell model. If the answer is in the affirmative, then processing returns to step 330, at which another net-to-gross value is selected from the set of estimated net-to-gross values. In this manner, a number (as specified by the user at step 330) of samples of the three dimensional reservoir framework cell model is sampled for each net-to-gross value selected at step 330.

Embodiments of the invention have many advantages. For example, embodiments of the invention eliminate the need to building a large, full-field reservoir model and upscaling the reservoir model. For another example, embodiments of the invention use a statistical sampling procedure to minimize the number of fine-scale simulations required and provide libraries of effective reservoir properties for specific geologic features, which can be maintained and used for other reservoirs. Further, embodiments of the invention provide a better statistical treatment of core data accounting for the volume differences between core plugs and geologic model cells.

Figure 4:
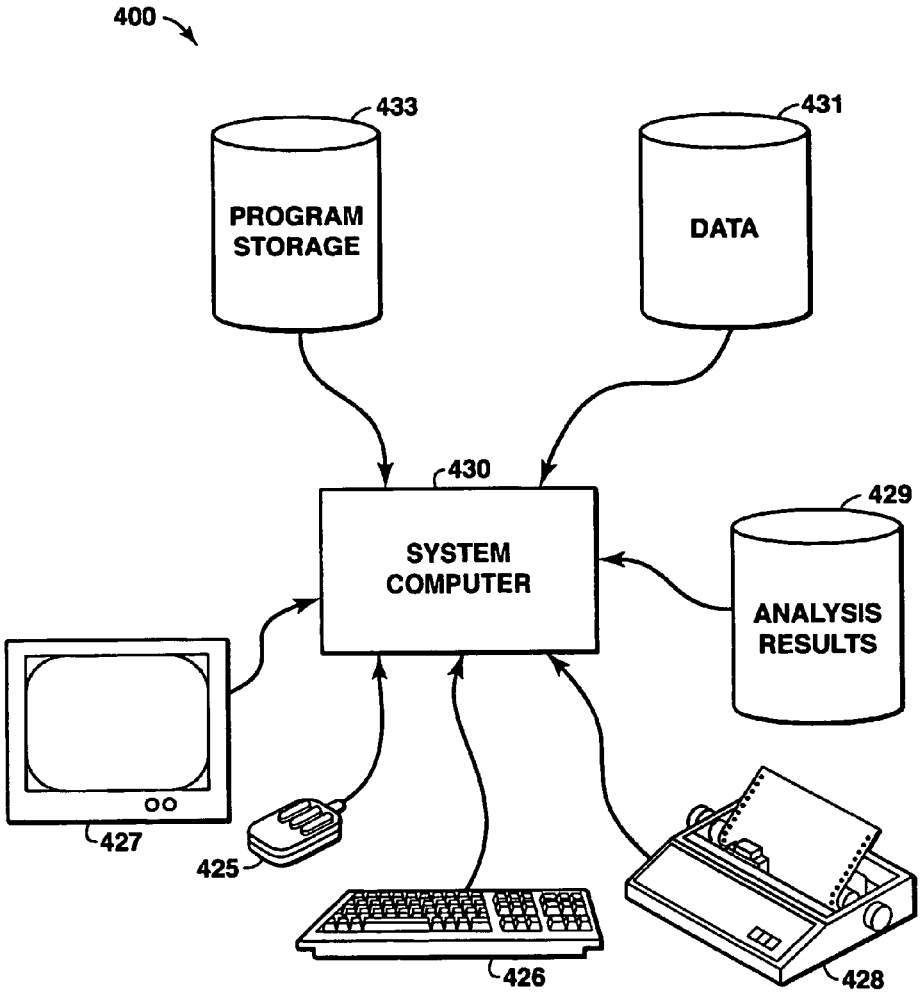
FIG. 4 illustrates a computer network, into which embodiments of the invention may be implemented.

FIG. 4 illustrates a computer network 400, into which embodiments of the invention may be implemented. The computer network 400 includes a system computer 430, which may be implemented as any conventional personal computer or workstation, such as a UNIX-based workstation. The system computer 430 is in communication with disk storage devices 429, 431, and 433, which may be external hard disk storage devices. It is contemplated that disk storage devices 429, 431, and 433 are conventional hard disk drives, and as such, will be implemented by way of a local area network or by remote access. Of course, while disk storage devices 429, 431, and 433 are illustrated as separate devices, a single disk storage device may be used to store any and all of the program instructions, measurement data, and results as desired.

In one embodiment, the input data are stored in disk storage device 431. The system computer 430 may retrieve the appropriate data from the disk storage device 431 to perform the reservoir model generation according to program instructions that correspond to the methods described herein. The program instructions may be written in a computer programming language, such as C++, Java and the like. The program instructions may be stored in a computer-readable memory, such as program disk storage device 433. Of course, the memory medium storing the program instructions may be of any conventional type used for the storage of computer programs, including hard disk drives, floppy disks, CD-ROMs and other optical media, magnetic tape, and the like.

According to a preferred embodiment, the system computer 430 presents output primarily onto graphics display 427, or alternatively via printer 428. The system computer 230 may store the results of the methods described above on disk storage 429, for later use and further analysis. The keyboard 426 and the pointing device (e.g., a mouse, trackball, or the like) 225 may be provided with the system computer 430 to enable interactive operation.

The system computer 430 may be located at a data center remote from the reservoir. While FIG. 4 illustrates the disk storage 431 as directly connected to the system computer 430, it is also contemplated that the disk storage device 431 may be accessible through a local area network or by remote access. Furthermore, while disk storage devices 429, 431 are illustrated as separate devices for storing input data and analysis results, the disk storage devices 429, 431 may be implemented within a single disk drive (either together with or separately from program disk storage device 433), or in any other conventional manner as will be fully understood by one of skill in the art having reference to this specification.

What is claimed is:

1. A method for generating a hydrocarbon reservoir model, comprising:

providing a reservoir framework having a plurality of three-dimensional cells;

building a cell framework having a plurality of cells, wherein the cell framework comprises two or more cells of the reservoir framework;

selecting a net-to-gross value from a set of estimated net-to-gross values;

populating the cells of the cell framework with rock-type values that correspond to the selected net-to-gross value;

populating the cells of the cell framework with one or more reservoir property values to generate a reservoir cell model;

extracting one or more cell samples from the cell model, wherein each cell sample is substantially the same size as one cell of the first framework;

performing, on a computer, a flow simulation on the cell sample to generate one or more effective reservoir property values;

extracting other cell samples from the cell model when a user-specified number of cell samples has not been sampled, and performing on a computer a flow simulation on said other cell samples, and further calculating a variability in effective reservoir property values generated from said other cell samples;

selecting another net-to-gross value from the set of estimated net-to-gross values when a user-specified number of cell samples has been sampled, and repeating, using said selected another net-to-gross value, said steps of populating the cells of the cell framework with rock-type values, populating the cells of the cell framework with one or more reservoir property values, extracting one or more cell samples from the cell model, performing, on a computer, a flow simulation, and extracting other cell samples from the cell model; and outputting the effective reservoir property values when a change in the variability of effective reservoir property values is less than a predetermined amount.

2. The method of claim 1, wherein each one of the cells of the cell framework is substantially the same size as a sample of well data.

3. The method of claim 1, wherein each one of the cells of the cell framework is substantially the same size as a sample of core data.

4. The method of claim 1, wherein each one of the cells of the cell framework is substantially the same size as a sample of log data.

5. The method of claim 1, further comprising identifying some or all of the cells of the cell framework as net or non-net.

6. The method of claim 1, further comprising identifying some or all of the cells of the cell framework as sand or shale.

7. The method of claim 1, further comprising populating some or all of the cells of the cell framework with net and non-net values.

8. The method of claim 1, further comprising receiving one or more estimated rock-type fraction values of the reservoir framework.

9. The method of claim 8, wherein the rock-type fraction values are net-to-gross values.

10. The method of claim 8, further comprising identifying some or all of the cells of the cell framework as net or non-net according to the estimated rock-type fraction values of the reservoir framework.

11. The method of claim 10, wherein the rock-type fraction values are net-to-gross values.

12. The method of claim 8, further comprising populating some or all of the cells of the cell framework with net and non-net values according to the estimated rock-type fraction values of the reservoir framework.

13. The method of claim 12, wherein the rock-type fraction values are net-to-gross values.

14. The method of claim 1, wherein the one or more reservoir property values comprise one or more porosity values.

15. The method of claim 1, wherein the one or more reservoir property values comprise one or more permeability values.

16. The method of claim 1, wherein the one or more reservoir property values comprise one or more water saturation values.

17. The method of claim 1, wherein the reservoir model is a flow simulation model.

18. The method of claim 1, wherein the reservoir model is a geologic model.

* * * * *